US009488169B2

(12) United States Patent
Cochran et al.

(10) Patent No.: US 9,488,169 B2
(45) Date of Patent: Nov. 8, 2016

(54) TORQUE ALLOCATING SYSTEM FOR A VARIABLE DISPLACEMENT HYDRAULIC SYSTEM

(71) Applicant: Coneqtec Corp., Wichita, KS (US)

(72) Inventors: Gary L. Cochran, Colwich, KS (US); Mark D. Bird, Clearwater, KS (US); William H. Dillahunty, Wichita, KS (US); Dan E. Starns, Goddard, KS (US)

(73) Assignee: Coneqtec Corp., Wichita, KS (US)

( * ) Notice: Subject to any disclaimer, the term of this patent is extended or adjusted under 35 U.S.C. 154(b) by 423 days.

(21) Appl. No.: 13/746,341

(22) Filed: Jan. 22, 2013

(65) Prior Publication Data

US 2013/0189118 A1 Jul. 25, 2013

Related U.S. Application Data

(60) Provisional application No. 61/589,611, filed on Jan. 23, 2012.

(51) Int. Cl.

| | |
|---|---|
| ***F04B 49/06*** | (2006.01) |
| ***F04B 17/05*** | (2006.01) |
| ***F04B 35/00*** | (2006.01) |
| ***F04B 49/20*** | (2006.01) |
| ***F04B 23/04*** | (2006.01) |
| *F04B 49/02* | (2006.01) |

(52) U.S. Cl.

CPC ..... *F04B 49/065* (2013.01); *F04B 17/05* (2013.01); *F04B 23/04* (2013.01); *F04B 35/002* (2013.01); *F04B 49/20* (2013.01); *F04B 49/022* (2013.01)

(58) Field of Classification Search

CPC ..... F04B 23/04; F04B 49/065; F04B 49/20; F04B 49/022; F04B 17/05; F04B 35/002; F15B 2211/205; F15B 2211/20576

USPC ..... 417/2, 223, 219

See application file for complete search history.

(56) References Cited

U.S. PATENT DOCUMENTS

| | | | | |
|---|---|---|---|---|
| 2,158,182 | A * | 5/1939 | Goddard | 403/337 |
| 5,441,389 | A * | 8/1995 | Wolcott | F04B 49/065 318/432 |
| 5,951,258 | A * | 9/1999 | Lueschow et al. | 417/22 |
| 7,546,729 | B2 * | 6/2009 | Palmer et al. | 60/449 |

(Continued)

FOREIGN PATENT DOCUMENTS

| | | | |
|---|---|---|---|
| CN | 101310113 | A | 11/2008 |
| JP | 2002013155 | A | 1/2002 |

OTHER PUBLICATIONS

International Search Report and Written Opinion issued for PCT/US2013/022462, dated Jan. 22, 2013.

*Primary Examiner* — Devon Kramer
*Assistant Examiner* — Stephen Mick
(74) *Attorney, Agent, or Firm* — Woodard, Emhardt, Moriarty, McNett & Henry LLP

(57) ABSTRACT

Disclosed is a system for allocating torque, supplied in one embodiment by an engine, to multiple variable and fixed displacement pumps coupled together in a series by coupling elements interspersed between the pumps. A controller is included which monitors the torque applied to each coupling element. The controller automatically varies displacement in one or more of the variable displacement pumps to prioritize and allocate torque to optimize available torque while keeping the torque applied to each coupling element within the torque limit for that particular coupling element.

18 Claims, 7 Drawing Sheets

(56) References Cited

U.S. PATENT DOCUMENTS

| | | | | |
|---|---|---|---|---|
| 8,483,916 | B2 * | 7/2013 | Peterson et al. | 701/50 |
| 2005/0160727 | A1 | 7/2005 | Nakamura et al. | |
| 2006/0207248 | A1 | 9/2006 | Ariga et al. | |
| 2009/0056325 | A1 * | 3/2009 | Gary et al. | 60/421 |
| 2009/0223214 | A1 | 9/2009 | Drake et al. | |
| 2009/0293468 | A1 * | 12/2009 | Kim | 60/327 |
| 2010/0218493 | A1 * | 9/2010 | Nakamura et al. | 60/426 |
| 2012/0282115 | A1 * | 11/2012 | Du et al. | 417/53 |

* cited by examiner

TORQUE ALLOCATING SYSTEM FOR A VARIABLE DISPLACEMENT HYDRAULIC SYSTEM

FIELD OF THE INVENTION

The disclosed embodiments relate to hydraulic flow control systems. They are described in the context of a system that is added to prime movers, such as skid-steer loaders, but is believed to be useful in other applications as well.

BACKGROUND

Construction equipment and particularly skid-steer loaders in this example, use an engine (usually diesel) to provide power for both a ground drive system but also for hydraulic systems on board such as loader lift, bucket rollback, etc. In addition to drive pumps for the ground engagement wheels or tracks and a pump to lift the arms, additional pumps may be coupled to the engine to provide an external supply of fluid power through what is called auxiliary flow that is used to run attachments. Alternate or auxiliary attachments, for examples, may include powered implements such as a flail mower, planer, saw, slot cutter, broom, tiller, auger, jack hammer, stump cutter, asphalt grinder, trencher, chipper, etc. It is desirable to allocate torque associated with fluid flow and pumps in the system so that applied torque to the respective coupling and engine does not exceed a torque tolerance limit.

SUMMARY

A hydraulic system for use in a work vehicle with a powered implement is disclosed. In one embodiment, the system includes a plurality of variable and/or fixed displacement pumps coupled in series. Displacement and pressure sensors associated with the pumps monitor and report torque within the system. A logically programmed controller, such as a computer, monitors the displacement and pressure reports and, if necessary, can vary pump displacement to keep each drive coupling and each preceding coupler within its design limits. The controller may continuously monitor and allocate the engine's torque in an optimal manner.

One embodiment disclosed is a system for allocating torque from an engine power output on a primary mover that includes a first variable displacement pump operable to drive a first ground effect element along with a first coupling between the engine power output of a primary mover and the first variable displacement pump. Also included is a second variable displacement pump operable to drive a second ground effect element along with a second coupling between the first variable displacement pump and the second variable displacement pump. A variable displacement accessory pump is coupled to the second variable displacement pump and is operable to power a tool implement. Each coupling has a torque load rating, and the total torque load applied to the second coupling is the sum of the torque load applied by the accessory pump and second variable displacement pump. Also, the total torque load applied to the first coupling is the sum of the torque load applied by the accessory pump, the second variable displacement pump and the first variable displacement pump. Also included is a controller monitoring the torque loads applied to the first coupling and the second coupling such that the controller applies control logic to reduce the displacement of one or more of the variable displacement pumps when the torque load of the first or second coupling elements approaches that coupling element's torque load rating.

Various aspects of the control logic are disclosed as well. In one aspect, the controller monitors the torque loads applied to the first coupling and the second coupling using pressure and displacement sensors associated with each variable displacement pump. In another aspect, the controller is programmed with prioritized control logic to reduce operation of the accessory variable displacement pump in a prioritized order relative to operations of the first and second variable displacement pumps. In still another aspect, the controller is programmed with prioritized control logic to control operation of the accessory variable displacement pump in allocated proportions relative to operations of the first and second variable displacement pumps. In another aspect, the controller is programmed with control logic to control the displacement of one or more of the variable displacement pumps based on measurements of one or more of an accessory feed rate and a ground effect movement rate. In yet another aspect, the controller is further programmed with control logic to control one or more of an accessory feed rate and a ground effect movement rate in conjunction with controlling the variable displacement pumps.

In another aspect, the system includes a loader pump coupled to the accessory pump, a third coupling between the second variable displacement pump and the accessory variable displacement pump. In this arrangement, the total torque load applied to the third coupling is the sum of the torque load applied by the accessory pump and the loader pump, the controller monitors the torque load applied to the third coupling, and the controller applies control logic to reduce the displacement of the accessory pump when the torque load of the third coupling approaches that coupling's torque load rating.

In another embodiment of the system disclosed below, the first variable displacement pump is coupled to the engine output of a skid-steer loader. In related embodiments, the power tool is selected from the group comprised of a flail mower, a planer, a saw, a slot cutter, a broom, a tiller, an auger, a jack hammer, a stump cutter, an asphalt grinder, a trencher, and a chipper.

Also disclosed is a system for allocating torque from an engine power output on a primary mover that includes a plurality of pumps including one or more variable displacement pumps, where an initial one of the pumps is coupled to the engine power output of a primary mover and the plurality of pumps are arranged in series with the initial pump closest to the engine followed by successive pumps and including a pump furthest from the engine. An initial coupling element is arranged between an engine power output and the initial pump with successive coupling elements arranged between adjacent pumps forming the series of the plurality of pumps, each coupling element having a torque load rating. The total torque load applied to each coupling element is the sum of the torque load applied by pumps successive to that coupling element. A controller monitors the torque load applied to each coupling element applying pre-programmed logic and measured torque loads to controllably vary the displacement of one or more variable displacement pumps successive to a coupling element when the torque load of that coupling element approaches that coupling element's torque load rating.

This embodiment includes various aspects of the controller logic. In one aspect, the controller monitors the torque loads applied to the coupling elements by the one or more variable displacement pumps using pressure and displacement sensors associated with each variable displacement pump. In another aspect, the plurality of pumps includes one or more fixed displacement pumps, and wherein the controller monitors the torque loads applied to the coupling elements by the one or more fixed displacement pumps using a pressure sensor associated with each fixed displacement pump.

In a similar related embodiment of the system and control logic, the plurality of pumps includes two or more variable displacement pumps and the controller is programmed with prioritized control logic to control operation of the two or more variable displacement pumps in a prioritized order. In another aspect, the plurality of pumps includes two or more variable displacement pumps and the controller is programmed with prioritized control logic to control operation of the two or more variable displacement pumps in allocated proportions. Finally, a third aspect is disclosed where the plurality of pumps includes two or more variable displacement pumps and the controller is programmed with control logic to independently control the displacement of the two or more variable displacement pumps based on the operation of one or more elements by the plurality of pumps.

In another embodiment, a system for allocating torque from an engine power output on a primary mover is disclosed which includes a plurality of pumps including two or more variable displacement pumps and the initial one of the pumps is coupled to the engine power output of a primary mover. The plurality of pumps are arranged in series with the initial pump closest to the engine followed by successive pumps and including a pump furthest from the engine. An initial coupling element is arranged between an engine power output and the initial pump and with successive coupling elements arranged between adjacent pumps forming the series of the plurality of pumps, each coupling element having a torque load rating. The total torque load applied to each coupling element is the sum of the torque load applied by pumps successive to that coupling element. A controller monitors the torque load applied to each coupling element, and the controller applies pre-programmed logic and measured torque loads to controllably vary the displacement of one or more variable displacement pumps to reduce torque within the system when the torque load of a coupling element approaches that coupling element's torque load rating.

Various aspects of controller logic are also disclosed in conjunction with this embodiment as well. In one aspect, the controller applies pre-programmed logic and measured torque loads to controllably increase the displacement of one or more variable displacement pumps within the system while maintaining the torque load applied to each coupling element in the system below that coupling element's torque load rating. In another aspect, the controller is programmed with prioritized control logic to increase the displacement of the two or more variable displacement pumps in a prioritized order while maintaining the torque load applied to each coupling element in the system below that coupling element's torque load rating. In yet another aspect, the controller is programmed with prioritized control logic to decrease the displacement of the two or more variable displacement pumps in a prioritized order to maintain the torque load applied to each coupling element in the system below that coupling element's torque load rating. And in a further related aspect, the controller is programmed with prioritized control logic to controllably increase or decrease the displacement of the two or more variable displacement pumps in allocated proportions while maintaining the torque load applied to each coupling element in the system below that coupling element's torque load rating.

Other objects and advantages of embodiments of the present invention are apparent from the description, figures and claims.

DETAILED DESCRIPTION

Figure 1:
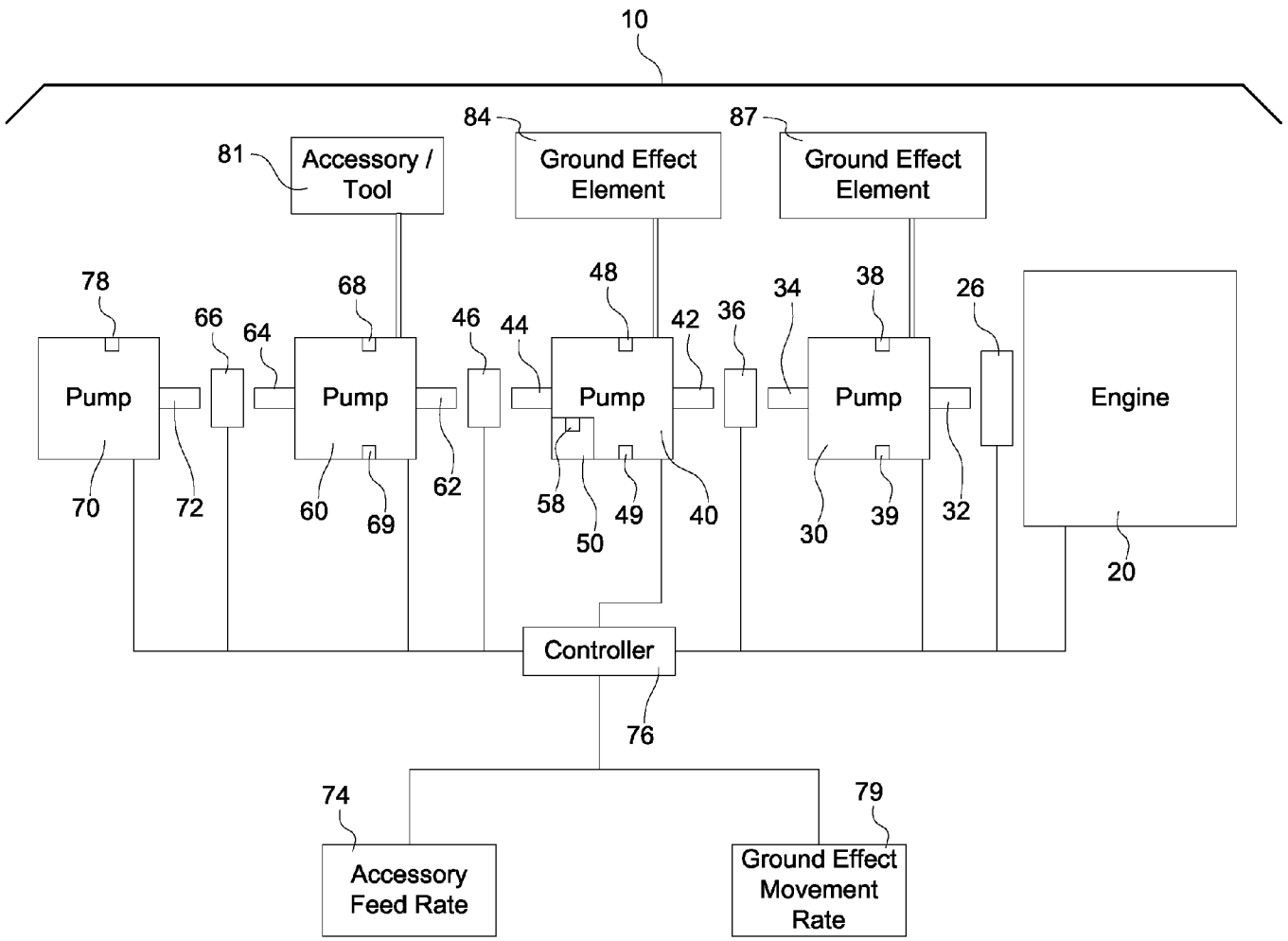
FIG. 1 is an exploded schematic view of an engine and pump arrangement according to one embodiment of the disclosure.

For the purposes of promoting an understanding of the principles of the disclosure, reference will now be made to the embodiment illustrated in the drawings and specific language will be used to describe the same. It will nevertheless be understood that no limitation of the scope of the claims is thereby intended, such alterations and further modifications in the illustrated device, and such further applications of the principles of the disclosure as illustrated therein, being contemplated as would normally occur to one skilled in the art to which the disclosure relates.

In a pump within a hydraulic system, torque can be calculated as a function of pressure and pump displacement. Specifically, torque ($\tau$) is given by the formula:

$$\tau = \frac{P * D}{2\pi}$$

where $\tau$ is the torque in inch-pounds, P is the pressure in pounds per square inch, and D is the displacement measured in cubic inches per revolution. Typically, a system would be designed by looking at the maximum possible loads that each pump could put on each coupler. Starting with the pump furthest from the engine, the total torque is calculated as the sum of torques that can be put on each successive coupler working towards the coupling closest to the engine. However, the total torque applied to a coupler cannot exceed its specified torque limit. The pumps can be a combination of fixed displacement and/or variable displacement pumps. In actual practice, it is a rare occasion where each of the string of pumps would ever need to run at maximum displacement and at maximum pressure. However, since the possibility does exist, the design limits are based on the theoretical maximum combined torque load. The need to maintain this system within design limits can severely limit the available torque allowed from each pump in such prior arrangements.

Embodiments of the present system use a sensor and computer arrangement which senses the displacement and pressure of each pump in the series. On the fixed displacement pumps only the pressure is monitored. On the variable displacement pumps, both the pressure and the flow are monitored to measure torque and can be controlled by the computer. Using control logic programmed into the computer, the variable displacement pumps can be systematically varied in displacement to keep each drive coupling and/or each preceding coupler within its design limits, thus according greater use of total hydraulic output torque by continuously monitoring and allocating the torque to the proper functions.

FIG. 1 shows a schematic diagram of an example embodiment of system 10 including an engine and pumps. Engine 20 is the primary power supply, typically mounted on a primary mover such as a tractor or skid/steer loader. Coupled to engine 20 are drive pumps such as a first pump 30 and a second pump 40. First and second pumps 30 and 40 are typically used to drive ground effect elements 84 and 87 such as wheels or tracks/treads at a ground effect movement rate 79. In the illustrated example, first pump 30 drives a left side ground drive and second pump 40 drives a right side ground drive, but that optionally can be reversed.

First pump 30 includes an input drive shaft 32 coupled using coupler 26 to a power output from engine 20. The power output from engine 20 can be a flywheel, a direct drive shaft, a power take-off belt or chain or another type of mechanical power transfer connection. First pump 30 includes an output shaft 34 coupled to an input shaft 42 of second pump 40 via coupler 36.

In the illustrated example, second pump 40 is combined with an internal third pump 50 which functions as a charging pump to provide supplemental pressure due to pressure degradation within the system and/or to provide pressure for controls such as pressure operated pilot control valves.

In the version illustrated, a fourth or accessory pump 60 is coupled to second pump 40. An input drive shaft 62 is coupled using coupler 46 to a power output shaft 44 from pump 40. A fifth pump 70, which can be used for loader and other equipment functions, is coupled to fourth pump 60. Fifth pump 70 is driven by an input shaft 72 coupled to an output shaft 64 via coupler 66. The arrangement of pumps in the illustrated series in system 10 is for purposes of demonstration, an alternate order of pumps and functions and more or less pumps can optionally be used as desired for a specific system arrangement.

Examples of coupling arrangements usable as couplers 26, 36, 46 and 66 are splined male/female coupling elements matched to the input and output shafts and interspersed between the pumps as shown; however, other coupling arrangements can be used. In a less desirably arrangement, a single shaft connecting an input to an output without a coupling could be used, in which case the torque limit of the shaft would be the limiting value. Input/output shafts are discussed herein as examples, but other mechanical power transfer methods such as belts, chain drives, or gearing can be used. In optional alternatives, breakaway couplers could be used which disengage from transferring power if applied torque exceeds a designed threshold.

Figure 2:
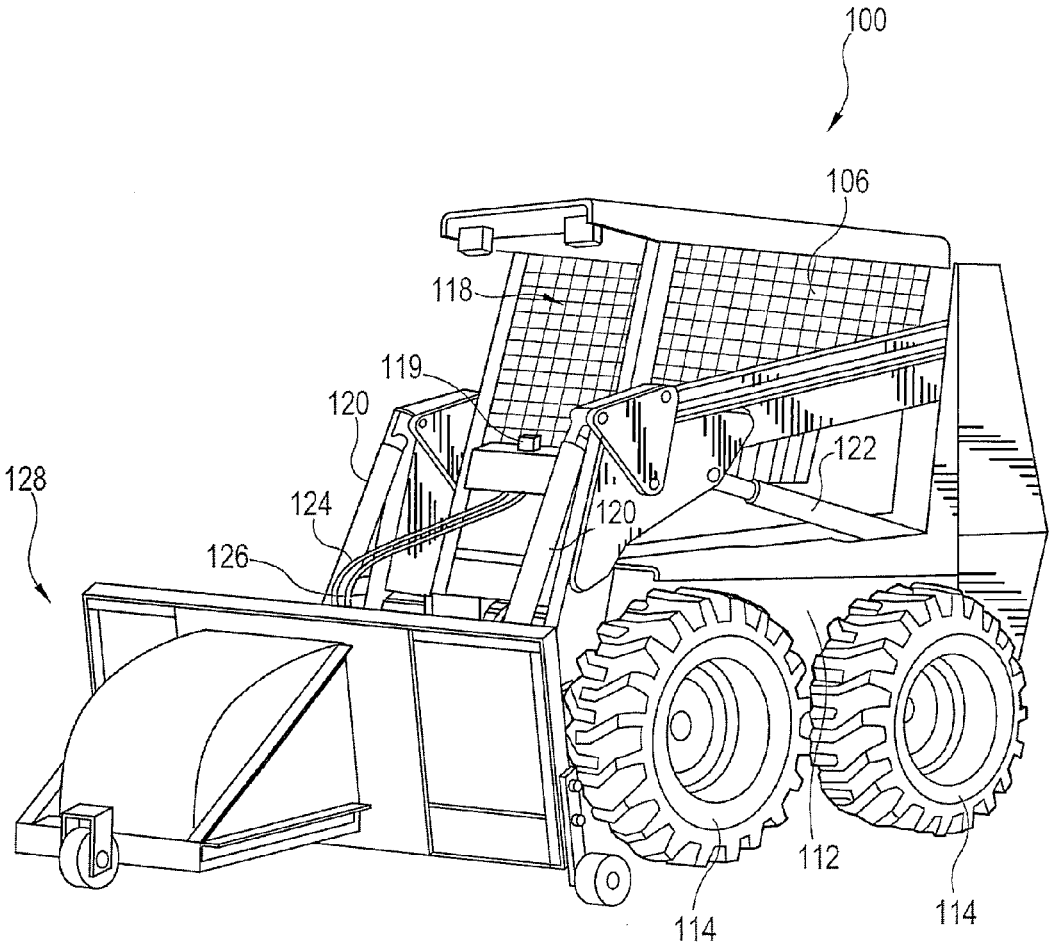
FIG. 2 is a perspective view of one embodiment of a primary mover configured to use the engine and pump arrangement of FIG. 1.

System 10 can be used for example with a skid-steer loader or similar support vehicle, an embodiment of which is shown in FIG. 2 at 100. Skid-steer loader 100 is type of support vehicle having a frame 112, four wheels 114 or tracks, for example driven by pumps 30 and 40, an operator position, such as a cage or cab 106 with a seat 118, and a pair of left and right front lift arms 120. Left and right hydraulic cylinders 122 may be paired with lift arms 120 and may, for example, be driven by pump 70 to raise and lower lift arms 120. A powered work tool implement 128 may be interchangeably mounted to the skid-steer loader, for example by being coupled and uncoupled from the lift arms and coupled to power supplied by accessory pump 60. Power from accessory pump 60 is supplied by a flow of hydraulic fluid through a fluid pressure line 124 and a return line 126. Examples of powered tool implements include a flail mower, planar (shown in FIG. 2), saw, slot cutter, broom, tiller, auger, jack hammer, stump cutter, asphalt grinder, trencher, and chipper.

Some implements require a low pressure with a high or low flow volume of hydraulic fluid to the implement through line 124, while others need a high pressure and high or low flow volume. For purposes of illustration, an example of high flow/low pressure system would be 40 gpm at 3300 psi, and an example of a high pressure/low flow system would be 34 gpm at 4200 psi. These examples are considered design-based numbers and the flow and pressure in actual operation may vary depending on the system set-up and load.

The skid-steer loader typically includes a hydraulic reservoir with a hydraulic fluid supply. Each hydraulic pump typically draws hydraulic fluid from the reservoir via a supply line and feeds fluid under pressure to the system element being driven by the pump. Fluid exiting the driven element may return to the reservoir or alternately can be recirculated back to the pump. In certain embodiments, fluid flow in one or more pumps may be reversed to reverse the operation of the driven element. The fluid flow direction and pressure can preferably be regulated and controlled using electric solenoid and/or hydraulically controlled switches, flow valves and check valves.

System 10 is illustrated using a combination of variable displacement and fixed displacement pumps. As illustrated, pumps 30, 40 and 60 are variable displacement pumps, while pumps 50 and 70 are fixed displacement pumps. Variable displacement pumps typically allow the output pressure and flow to be continuously varied and controlled within a range, while fixed displacement pumps have a pre-established output. The examples used in system 10 are for purposes of demonstration, alternate permutations of fixed and variable displacement pumps can alternately be used.

System 10 incorporates one or both of pressure and displacement sensors associated with each pump within system 10. Typically, each variable displacement pump such as pumps 30, 40 and 60 incorporates both pressure sensors 38, 48 and 68 and displacement sensors 39, 49 and 69. Typically each fixed displacement pump only incorporates a pressure sensor, such as sensors 58 and 78 associated with pumps 50 and 70. Each sensor reports sensed pressure or displacement to a control system such as a computer or PLC arrangement.

Other embodiments of system 10 are envisioned as well. For example a system for allocating torque from an engine power output on a primary mover comprises a plurality of pumps including one or more variable displacement pumps. An initial one of the pumps is coupled to the engine power output of a primary mover and the plurality of pumps are arranged in series with the initial one of the pumps closest to the engine followed by successive pumps and including a pump furthest from the engine. An initial coupling element arranged between an engine power output and the initial pump and successive coupling elements are arranged between adjacent pumps forming the series of the plurality of pumps, each coupling element having a torque load rating. The total torque load applied to each coupling element is the sum of the torque load applied by pumps successive to that coupling element. A controller 76 monitoring the torque load applied to each coupling element applies pre-programmed logic and measured torque loads to controllably vary the displacement of one or more variable displacement pumps successive to a coupling element when the torque load of that coupling element approaches that coupling element's torque load rating.

In another related embodiment, the initial one of the pumps discussed above is a first variable displacement pump operable to drive a first ground effect element 84, and the one or more variable displacement pumps includes a second variable displacement pump operable to drive a second ground effect element 87 producing a ground effect movement rate 79. The controller 76 applies control logic as illustrated in FIG. 3 to reduce the displacement of one or more of the variable displacement pumps at 314 when the torque load of the first or second coupling elements approaches that coupling element's torque load rating at 308 and 312 respectively.

In another alternate embodiment, the plurality of pumps discussed above includes two or more variable displacement pumps, wherein an initial one of the pumps is coupled to the engine power output of a primary mover, and wherein the controller 76 applies pre-programmed logic and measured torque loads to controllably vary the displacement of one or more variable displacement pumps to reduce torque within the system when the torque load of a coupling element approaches that coupling element's torque load rating.

Figure 3:
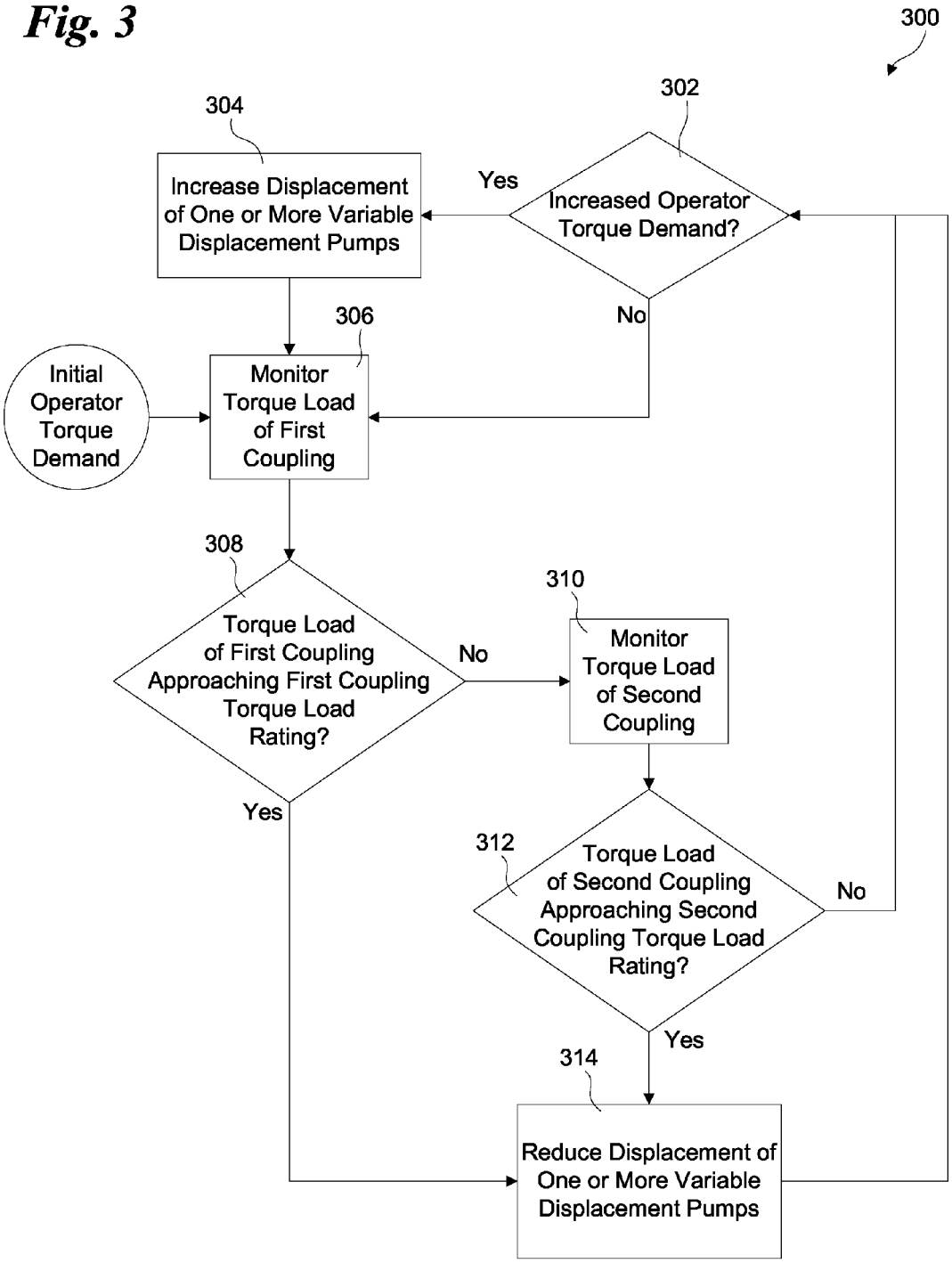
FIG. 3 is a flow chart illustrating an example of controller logic useful for controlling the system of FIG. 1.

The control system incorporates pre-programmed logic and sensor measurements to monitor torque at 306 and 310 in FIG. 3 and can control the pumps within system 10 in response to sensed conditions. As needed, the pumps can be systematically and independently varied in displacement to control torque applied to each drive coupling and correspondingly torque applied to each preceding coupler to maintain applied torque to each of the couplers within their design limits, thus according greater use of hydraulic output torque by continuously monitoring and allocating the available torque.

In the illustrated configuration, drive pumps 30 and 40 as well as accessory pump 60 and pump 70 are enabled to run at their designated maximum flow and pressure rate unless or until the specified torque limit in any of the couplers is approached or met at 308 and/or 312 in FIG. 3. For example, a specified torque limit may be 85% of the maximum allowable torque for each coupler within system 10. The maximum allowable torque is typically set by the coupler supplier.

If a torque limit is approached or met, the control system logically reduces displacement in one or more of the variable displacement pumps, to reduce overall torque in the system as shown in FIG. 3 at 312. In one example illustrated in FIG. 4A, control logic in the controller 76 varies the torque load on couplers 26, 36, and 46 by reducing or increasing the displacement of the "next pump" at 406 that is furthest from the engine coupled to the coupling element which is approaching its torque limit as determined at 402 and 404. For example, if coupling element 36 is approaching its torque limit at 402, the controller 76 increases and decreases the displacement in pump 40 at 406 to obtain the desired output from pump 40 without exceeding the torque limit for coupling element 36. If changing the displacement in the first succeeding pump in the chain (pump 40 in this example) does not alleviate the potentially excessive torque demands on a given coupling element at 408, the controller 76 reduces displacement at 406 in the "next pump" in the chain furthest from the engine (pump 60 in this example) as determined at 404. In this way the control logic varies the displacement to enable the maximum available torque output subject to the control of the operator at 302.

Figure 4A:
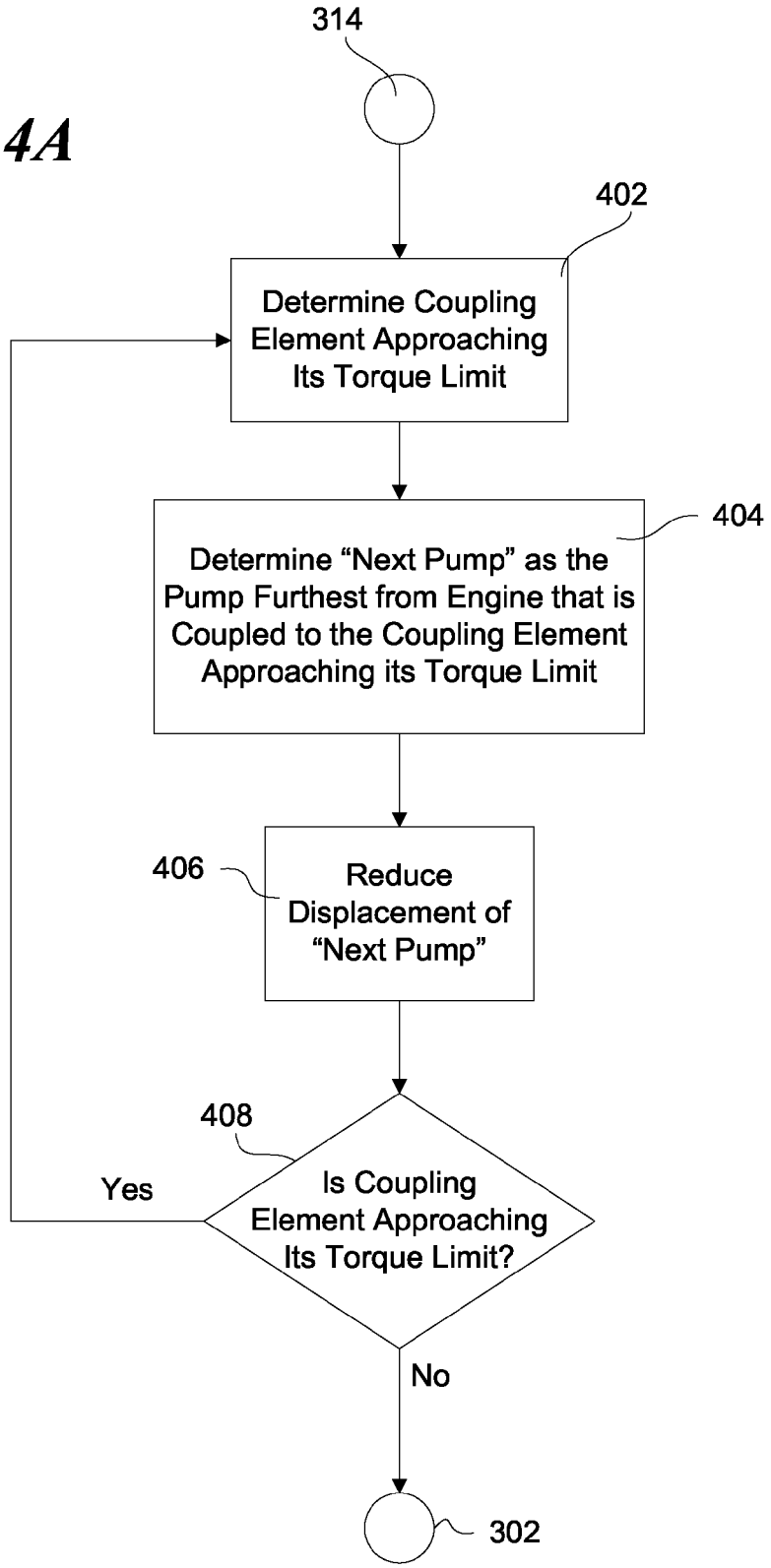
FIG. 4A-4C are flow charts illustrating examples of controller logic useful for reducing the displacement of variable displacement pumps in the system of FIG. 1.
Figure 4B:
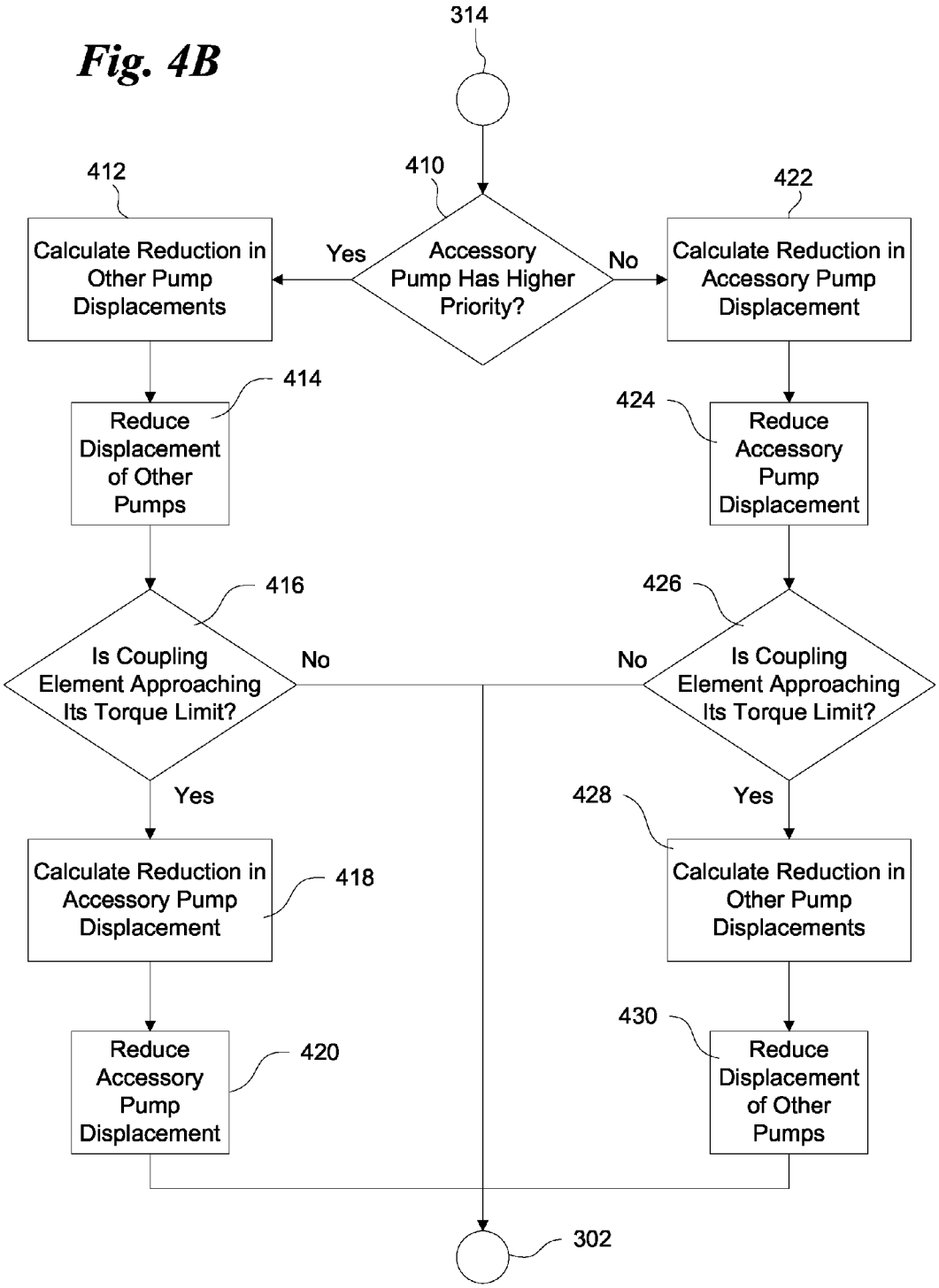

Alternately, as illustrated in FIG. 4B, the control system may be prioritized at 410 to first reduce power to ground drive elements at 412 and 414 by reducing displacement in pumps 30 and 40 to reduce the ground effect movement rate 79 (i.e. ground speed) of the primary mover while maintaining full power to accessory pump 60 at 418 and 420. In this example, the controller 76 varies the displacement in two or more pumps by approximately equal amounts at about the same time. This is advantageous because substantial differences in the displacements of pumps 30 and 40 occurring at about the same time might result in the vehicle making an unexpected turn to the left or right. Therefore in this case, if either of coupling elements 26 or 36 is approaching its torque limit at 308, 312, or 416, the controller 76 independently varies the displacement of pumps 30 and 40 by approximately equal amounts at 414 at about the same time and monitors the resulting torque load throughout the system at 416. As the maximum torque available to pumps 30 and 40 is reduced, the operator might experience, for example, sluggish steering feedback, or reduced forward speed, as power is prioritized at 410 and 416 in favor of the powered implement by reducing available torque to the accessory 81 or powered implement last at 418 and 420. As torque loads on couplers 26 and 36 are reduced, the controller 76 increases displacement in pumps 30 and 40 enabling the ground drive elements to operate at maximum capacity subject to the operator's commands at 302.

Figure 4C:
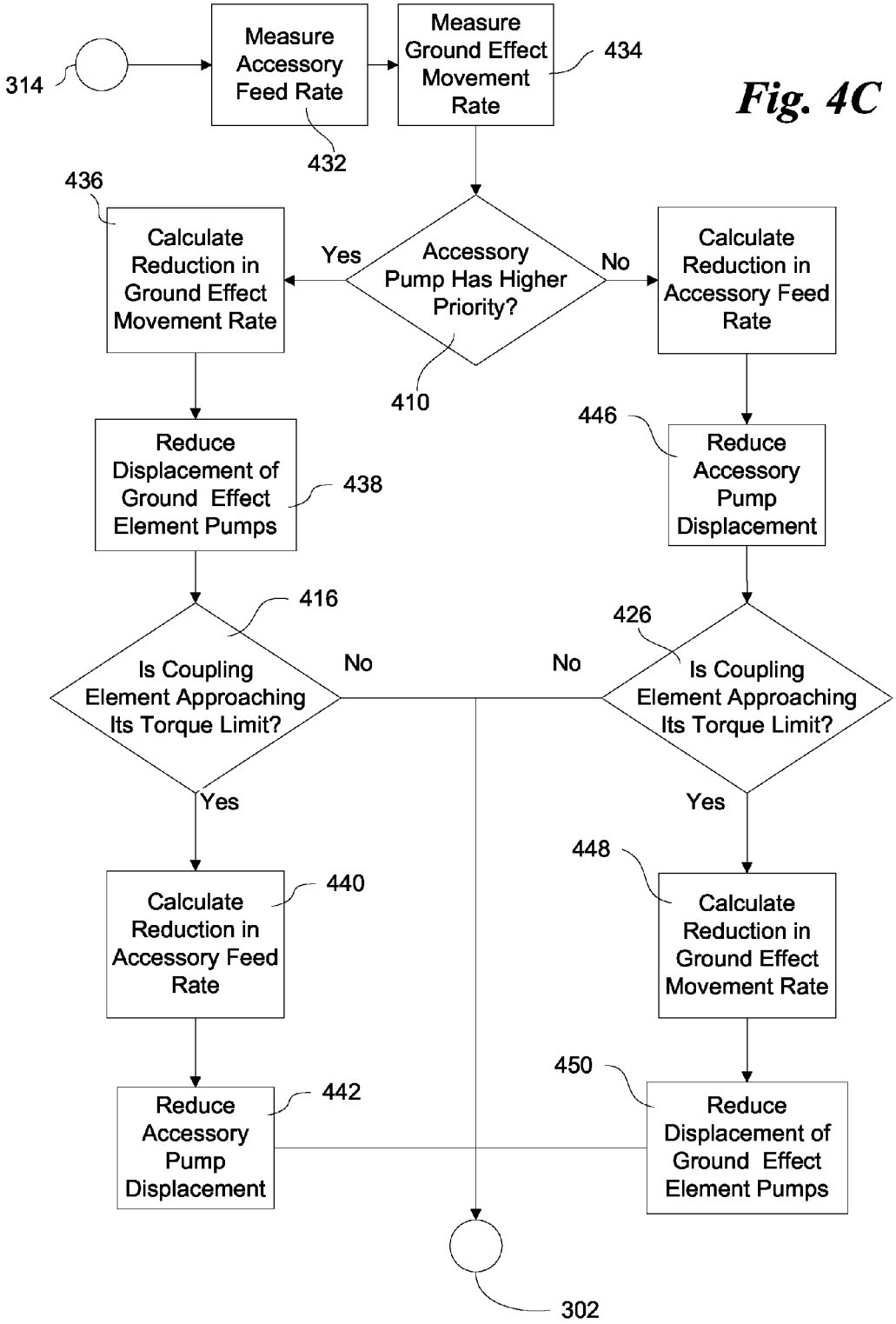

In certain arrangements, reducing the ground speed may have direct and indirect torque reduction effects. For example, as illustrated in FIG. 4C, when using certain accessories, such as an asphalt planer (as shown in FIG. 2) or another type of cutting tool, the applied torque within pump 60 may be in part a function of the ground speed of the primary mover, for example resistance to a planer or cutting tool can cause torque feedback into the accessory pump 60. In such arrangements, reducing the ground speed of the primary mover by directly reducing power to the ground elements correspondingly at 436 and 438 also reduces resistance to the accessory 81 and may thus indirectly also reduce torque in system 10 by reducing torque applied to the accessory pump 60.

More broadly, the torque applied to accessory pump 60 may be a function of the feed rate74 of the accessory 81 measured at 432, whether as a function of ground speed measured at 434 or as a function of moving the accessory 81 in a different manner. The control system may logically control the displacement of one or more pumps in the system at 438, or alternately may control a different accessory movement arrangement, to reduce the accessory feed rate 74 and to correspondingly reduce overall system torque. For example, controller logic may be programmed to independently maintain the required torque in the accessory pump 60 while also varying the displacement of ground element pumps 30 and 40 as necessary at 436 and 438. In this way, the controller 76 places priority on providing torque to the accessory pump 60 at 410 while varying the maximum available forward speed of the vehicle at 438 and 450 to avoid exceeding torque limits on couplers 26, 36, and 46.

In another example, illustrated in FIG. 4B, the control system may be programmed at 410 and 426 to prioritize by first reducing displacement in accessory pump 60 at 422 and 424 and thus reducing power to an accessory 81 while allowing ground drive pumps 30 and 40 to operate at maximum available power subject to the control of the operator at 302. In this example, the controller logic adjusts the displacement of pump 60 first at 422 and 424 if it determines any of coupling elements 26, 36, or 46 are approaching their torque limits. If these adjustments are insufficient at 426, only then is the displacement changed in the ground drive pumps 30 and 40 at 428 and 430 thus modifying the vehicles speed and/or steering responsiveness. Controller logic may be programmed to maintain required torque in the ground element pumps 30 and 40 at 428 and 430 while varying the displacement of accessory pump 60 at 422 and 424. The controller 76 thus places priority on providing torque to the ground element pumps 30 and 40 at 410 and 426 to maintain a chosen speed before allocating available torque to accessory pump 60.

If a first reduction is insufficient, the control system may then reduce displacement in multiple pumps in a prioritized order and/or in selected proportions as illustrated in FIGS. 4A-4C. Various combinations of the logic discussed above are also envisioned. For example, where excessive torque might require the controller 76 to completely eliminate all flow to the accessory pump 60 first (e.g. at 424 in FIG. 4B and 446 in FIG. 4C), before reducing flow to ground drive element pumps 30 and 40, and thus completely halt the power tool implement 128, the controller 76 might be programmed instead to incrementally reduce displacement by a predetermined percentage such as 10% first to pump 60 at 424 and/or 446 while also reducing displacement by another predetermined percentage such as 1% to all other variable displacement pumps simultaneously at 414 and 438 if torque on any of the coupling elements approached their respective limits (e.g. at 416 and 426 in FIG. 4B). This would, in effect reduce overall performance of the vehicle and the power tool implement 128 without completely halting any one system while prioritizing one system over another. Likewise, the control logic might be reversed in priority at 410 (in FIGS. 4B and 4C) and programmed to reduce displacement to ground drive element pumps 30 and 40 by a predetermined percentage at 438 such as 8% while reducing displacement to all other variable displacement pumps by another predetermined percentage such as 2% at 428.

In another example, the controller 76 may be programmed to avoid exceeding the torque limits of couplers 26, 36, and 46 by varying the overall torque input such as by regulating the throttle of the engine. In this case, the operator may set the throttle at a particular setting, then, when the controller 76 senses one or more of the couplers in system 10 is approaching its torque limit, the throttle may be varied incrementally to avoid exceeding these limits. Adjustments made by the controller 76 in this example are subject to changes made by the operator where, for example, the controller does not adjust the throttle to exceed the operator's setting at 302.

As discussed above, preferably once the total torque within system 10 falls below the torque limit, the control system restores displacement within system 10 to enable the maximum desired displacement in each pump within system 10 so long as the torque limit is not again exceeded. The order in which displacement to selected pumps is restored can be prioritized, allocated, and controlled as desired and discussed above and illustrated in FIG. 5.

Figure 5:
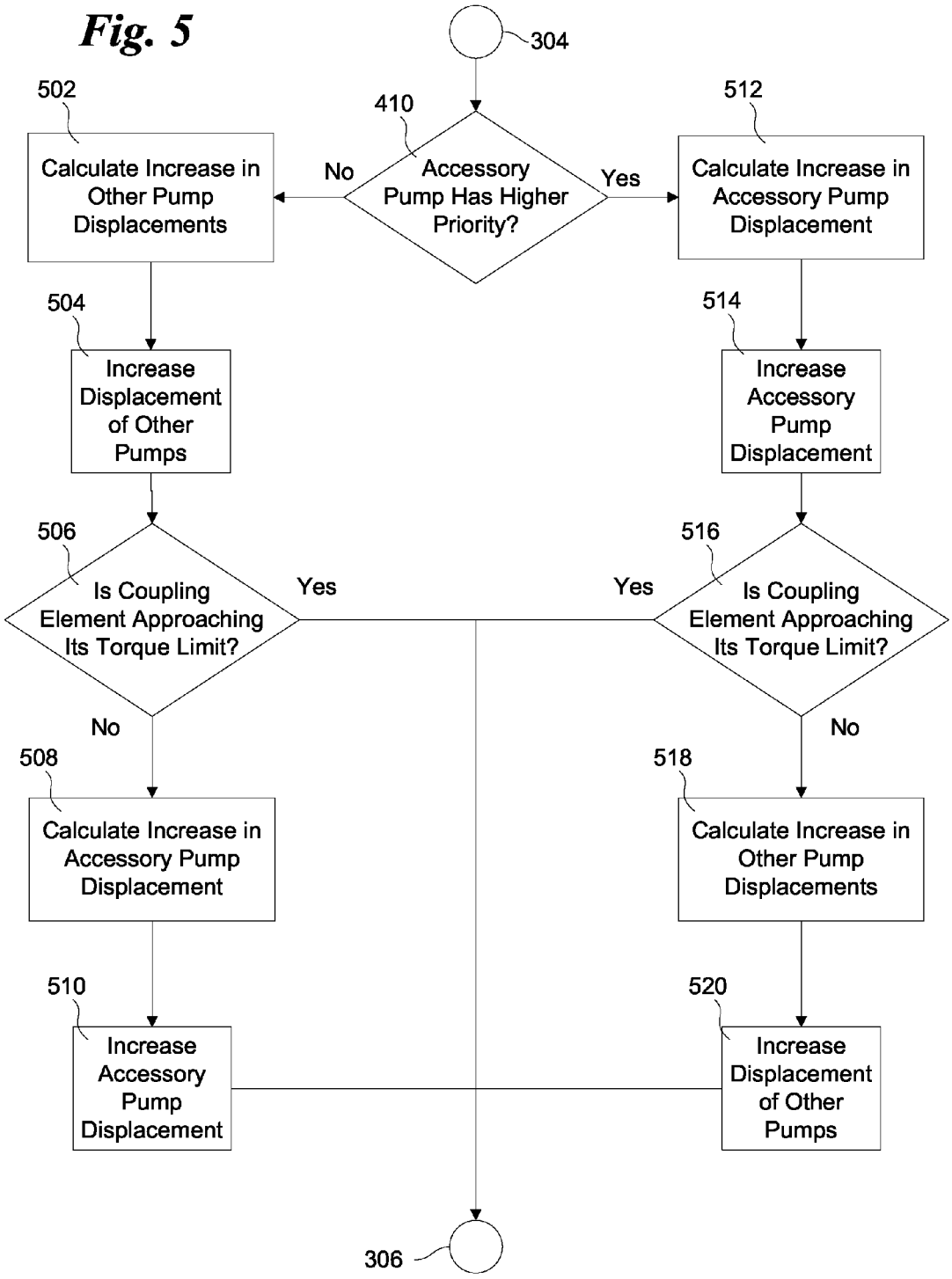
FIG. 5 is a flow chart illustrating an example of controller logic useful for increasing the displacement of variable displacement pumps in the system of FIG. 1.

Generally, the control system is enabled to dynamically balance and control displacement in the pumps within system 10 according to desired priorities at 410 in FIG. 5 to allocate total torque available from the engine to optimize power supplied to the accessory 81 at 512 and 514 as well as ground drive power and other system power at 502 and 504 while maintaining the total torque and individualized torque for each coupling below programmed torque limits at 506 and 516.

In other embodiments, appropriate sensors can be used to monitor alternate or additional variables, such as fluid, pump or coupler temperature or the presence/absence of fluid, to optimize the system state and to preferably allow control of the system to be used to minimize wear and tear on the system. In certain embodiments, the sensor and control system display system status information indications to the operator via gauges, displays, lights or similar status indicators and may provide visual or audio alerts if designated system thresholds are triggered.

The torque allocating system has been described in the context of its use in a skid-steer loader; however, it should be understood that the present torque allocating system is not limited to use in a skid-steer loader. The torque allocating system may be used with other loaders or work vehicles, or even in non-work vehicles or stationary apparatus where selective variability of flow and pressure in a hydraulic system is desired.

While the illustrated embodiments have been detailed in the drawings and foregoing description, the same is to be considered as illustrative and not restrictive in character, it being understood that only the preferred embodiment has been shown and described and that all changes and modifications that come within the spirit of the invention are desired to be protected. The articles "a", "an", "said" and "the" are not limited to a singular element, and include one or more such elements.

What is claimed is:

1. A system for allocating torque from an engine power output on a primary mover, comprising:

a first variable displacement pump operable to drive a first ground effect element;

a first coupling between the engine power output of a primary mover and the first variable displacement pump;

a second variable displacement pump operable to drive a second ground effect element;

a second coupling between the first variable displacement pump and the second variable displacement pump;

a variable displacement accessory pump coupled to the second variable displacement pump and operable to power a tool implement;

wherein each coupling has a torque load rating;

wherein the total torque load applied to the second coupling is the sum of the torque load applied by the accessory pump and second variable displacement pump; and wherein the total torque load applied to the first coupling is the sum of the torque load applied by the accessory pump, the second variable displacement pump and the first variable displacement pump;

a controller configured to monitor the torque loads applied to the first coupling and the second coupling using pressure and displacement sensors associated with each variable displacement pump;

wherein the controller is configured to control the variable displacement pumps to reduce the displacement of one or more of the variable displacement pumps when the torque load applied to the first or second coupling elements approaches that coupling element's torque load rating.

2. The system of claim 1, wherein the controller is programmed with prioritized control logic to reduce operation of the accessory variable displacement pump in a prioritized order relative to operations of the first and second variable displacement pumps.

3. The system of claim 1, wherein the controller is programmed with prioritized control logic to control operation of the accessory variable displacement pump in allocated proportions relative to operations of the first and second variable displacement pumps.

4. The system of claim 1, wherein the controller is programmed with control logic to control the displacement of one or more of the variable displacement pumps based on measurements of one or more of an accessory feed rate and a ground effect movement rate.

5. The system of claim 4, wherein the controller is programmed with control logic to control one or more of an accessory feed rate and a ground effect movement rate in conjunction with controlling the variable displacement pumps.

6. The system of claim 1, wherein the tool implement is selected from the group comprised of a flail mower, a planer, a saw, a slot cutter, a broom, a tiller, an auger, a jack hammer, a stump cutter, an asphalt grinder, a trencher, and a chipper.

7. The system of claim 1, comprising:

a loader pump coupled to the accessory pump, a third coupling between the second variable displacement pump and the accessory variable displacement pump, wherein the total torque load applied to the third coupling is the sum of the torque load applied by the accessory pump and the loader pump;

wherein the controller is configured to monitor the torque load applied to the third coupling, and wherein the controller is configured to reduce the displacement of the accessory pump when the torque load of the third coupling approaches that coupling's torque load rating.

8. The system of claim 1, wherein the first variable displacement pump is coupled to the engine output of a skid-steer loader.

9. A system for allocating torque from an engine power output on a primary mover, comprising:

a plurality of pumps including one or more variable displacement pumps, wherein an initial one of the pumps is coupled to the engine power output of a primary mover;

wherein the plurality of pumps are arranged in series with the initial one of the pumps closest to the engine followed by successive pumps and including a pump furthest from the engine, an initial coupling element arranged between an engine power output and the initial pump and with successive coupling elements arranged between adjacent pumps forming the series of the plurality of pumps, each coupling element having a torque load rating;

wherein the total torque load applied to each coupling element is the sum of the torque load applied by pumps successive to that coupling element;

a controller configured to monitor the torque load applied to each coupling element using pressure and displacement sensors associated with each variable displacement pump;

wherein the controller is configured to use pre-programmed logic to measure torque loads and to control the displacement of one or more variable displacement pumps successive to a coupling element when the torque load applied to that coupling element approaches that coupling element's torque load rating.

10. The system of claim 9, wherein the plurality of pumps includes one or more fixed displacement pumps, and wherein the controller is configured to monitor the torque loads applied to the coupling elements by the one or more fixed displacement pumps using a pressure sensor associated with each fixed displacement pump.

11. The system of claim 9, wherein the plurality of pumps includes two or more variable displacement pumps and wherein the controller is programmed with prioritized control logic to control operation of the two or more variable displacement pumps in a prioritized order.

12. The system of claim 9, wherein the plurality of pumps includes two or more variable displacement pumps and wherein the controller is programmed with prioritized control logic to control operation of the two or more variable displacement pumps in allocated proportions.

13. The system of claim 9, wherein the plurality of pumps includes two or more variable displacement pumps and wherein the controller is programmed with control logic to independently control the displacement of the two or more variable displacement pumps based on the operation of one or more elements by the plurality of pumps.

14. A system for allocating torque from an engine power output on a primary mover, comprising:

a plurality of pumps including two or more variable displacement pumps, wherein an initial one of the pumps is coupled to the engine power output of a primary mover;

wherein the plurality of pumps are arranged in series with the initial one of the pumps closest to the engine followed by successive pumps and including a pump furthest from the engine, an initial coupling element arranged between an engine power output and the initial pump and with successive coupling elements arranged between adjacent pumps forming the series of the plurality of pumps, each coupling element having a torque load rating;

wherein the total torque load applied to each coupling element is the sum of the torque load applied by pumps successive to that coupling element;

a controller configured to monitor the torque load applied to each coupling element using pressure and displacement sensors associated with each variable displacement pump;

wherein the controller is configured to use pre-programmed logic to measure loads to and to control the displacement of one or more variable displacement pumps to reduce torque within the system when the torque load applied to a coupling element approaches that coupling element's torque load rating.

15. The system of claim 14, wherein the controller is configured to measure torque loads and to use pre-programmed logic to increase the displacement of one or more variable displacement pumps within the system while maintaining the torque load applied to each coupling element in the system below each coupling element's torque load rating.

16. The system of claim 14, wherein the controller is programmed with prioritized control logic to increase the displacement of the two or more variable displacement pumps in a prioritized order while maintaining the torque load applied to each coupling element in the system below each coupling element's torque load rating.

17. The system of claim 14, wherein the controller is programmed with prioritized control logic to decrease the displacement of the two or more variable displacement pumps in a prioritized order to maintain the torque load applied to each coupling element in the system below each coupling element's torque load rating.

18. The system of claim 14, wherein the controller is programmed with prioritized control logic to controllably increase or decrease the displacement of the two or more variable displacement pumps in allocated proportions while maintaining the torque load applied to each coupling element in the system below each coupling element's torque load rating.

* * * * *